United States Patent [19]

Stewart

[11] 4,374,787

[45] Feb. 22, 1983

[54] PRESSING CERAMIC POWDERS

[75] Inventor: Roy Stewart, Blackpool, England

[73] Assignee: British Nuclear Fuels Limited, Warrington, England

[21] Appl. No.: 175,864

[22] Filed: Aug. 6, 1980

[30] Foreign Application Priority Data

Aug. 10, 1979 [GB] United Kingdom ..... 7928000

[51] Int. Cl.[3] ..... B30B 5/02; B30B 11/02

[52] U.S. Cl. ..... 264/0.5; 264/109; 264/337; 425/405 H; 425/406

[58] Field of Search ..... 425/405 H, 406; 264/0.5, 109, 337

[56] References Cited

U.S. PATENT DOCUMENTS

| | | | |
|---|---|---|---|
| 3,419,935 | 1/1969 | Pfeiler et al. | 425/405 H X |
| 3,495,939 | 2/1970 | Forrest . | |
| 3,550,198 | 12/1970 | Roberts | 425/405 H X |
| 3,571,854 | 3/1971 | Lundstrom | 425/405 H X |
| 3,604,060 | 9/1971 | Lundstrom | 425/405 H |
| 3,830,607 | 8/1974 | Baxendale et al. | 425/405 H X |
| 4,009,977 | 3/1977 | Chao | 425/405 H X |
| 4,097,977 | 7/1978 | Pollner | 425/405 H X |

*Primary Examiner*—J. Howard Flint, Jr.
*Attorney, Agent, or Firm*—William R. Hinds

[57] ABSTRACT

A pelleting press in which the die has at least a part which is fluid-permeable so that powder in the die can be compressed simultaneously by fluid permeating the die and mechanically from at least one end of the die. It has a particular application in the pelleting of nuclear fuel powders.

The die may be of reaction - sintered silicon carbide rendered fluid-permeable by removal of silicon.

7 Claims, 2 Drawing Figures

PRESSING CERAMIC POWDERS

BACKGROUND OF THE INVENTION

This invention relates to the pressing of ceramic powders. It finds a particular application in the fabrication of nuclear reactor fuel compacts, termed pellets in the art, comprising fissile material in oxide or carbide form.

SUMMARY OF THE INVENTION

According to the present invention in a press apparatus for forming bodies from ceramic powder by compacting the powder in a die the die is at least in part of fluid-permeable material and means are provided for exerting hydrostatic pressure through a fluid medium permeating the die while applying mechanical pressure to the powder at least at one end of the die.

The combination of mechanical pressing on the ends of a body and fluid pressure on its curved surface can simulate isostatic pressing and reduce the waisting due to friction losses which arise when mechanical pressing is used alone.

The fluid medium may be a liquid or gas and the die material may be reaction-sintered silicon carbide, that is, silicon carbide produced by sintering a body formed of a mixture of silicon carbide powder and carbon in the presence of molten silicon so that the carbon in the body is converted to silicon carbide, as described for example, in U.S. Pat. No. 3,495,939. Such a reaction-sintered silicon carbide body always contains some free silicon as a continuous phase and may be rendered fluid-permeable by treating the body with a solvent for the silicon, for example, sodium hydroxide.

It is preferable for only that portion of the die which will contain the compacted powder to be fluid permeable.

If the fluid medium is a liquid it may also serve to lubricate the die and associated parts by which mechanical pressure is exerted on powder in the die. Examples of liquids suitable in this respect are stearic acid and certain oils such as hydraulic oil or light machine oil.

Presses which can be modified in accordance with the invention are well-known.

DESCRIPTION OF THE DRAWINGS

An example of a press in accordance with the invention will now be described with reference to the accompanying drawings wherein.

DESCRIPTION OF A PREFERRED EMBODIMENT

Figure 1:
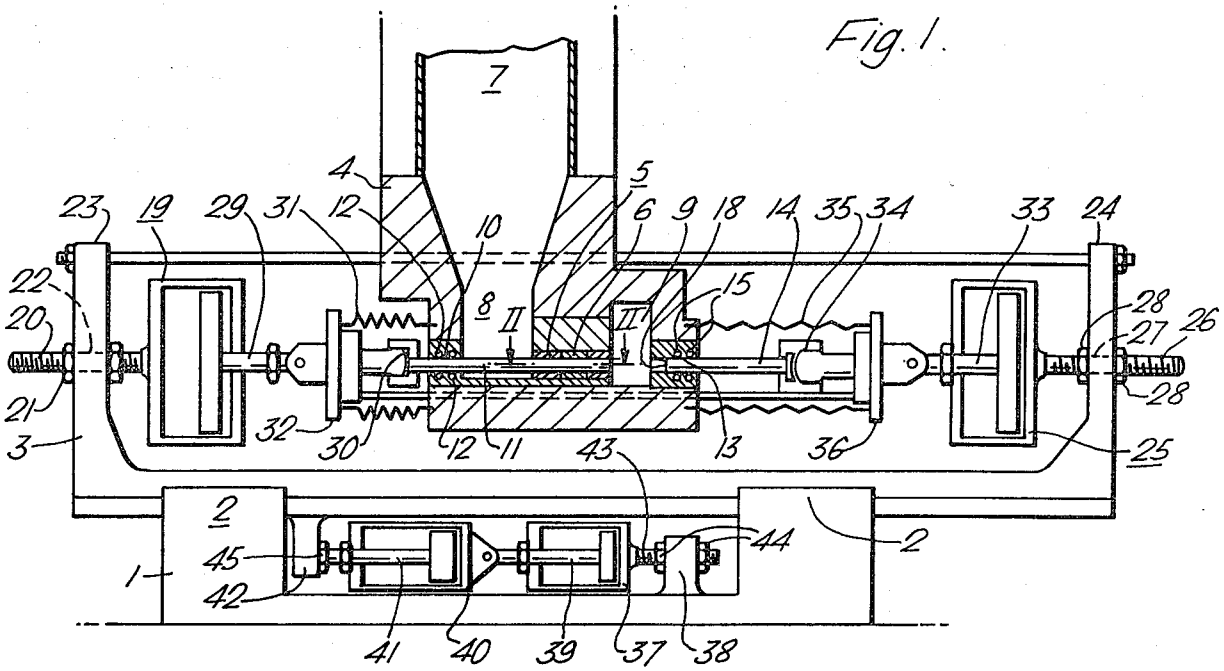
FIG. 1 is a side view partly in medial section of a powder compacting press for forming nuclear fuel pellets.
Figure 2:
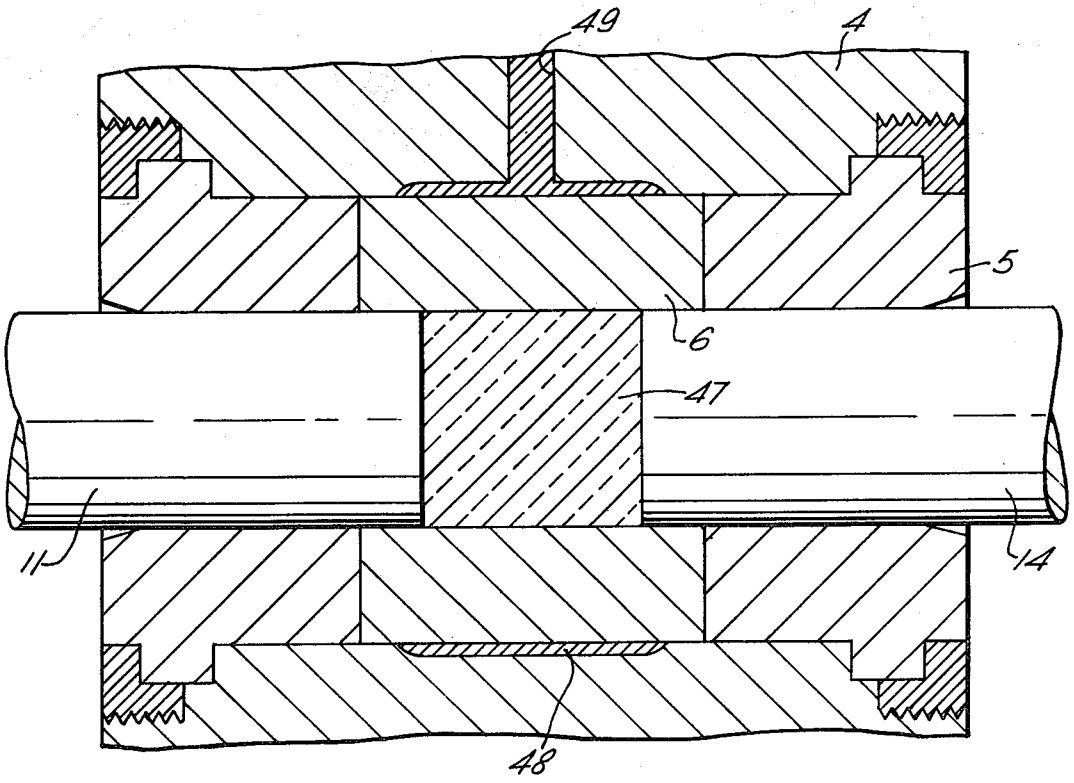
FIG. 2 is a view in medial section on the line II—II of FIG. 1, showing on a larger scale than FIG. 1 the die for the press of FIG. 1.

Referring to FIG. 1 of the drawings, this shows a press for forming right cylindrical pellets from ceramic nuclear fuel powder which may be uranium dioxide or a mixture of uranium dioxide and plutonium dioxide. The press has a bed plate 1 carrying a yoke 3 in parallel slides 2 and a die block 4 mounted so as to be immovable on the bed plate 1. A cylindrical die 5 is provided within the die block 4 by a removable tubular insert of reaction-sintered silicon carbide. As is shown more clearly in FIG. 2 the die 5 has a centre portion 6 which has been rendered fluid permeable by treatment with sodium hydroxide. Surrounding this centre portion 6 is an annulus 48 in the die block 4, filled with pressurising fluid and connecting through conduit 49 with an intensifier (not shown). An intensifier is a free piston with hydraulic pressure both ends, the pressure ratio being determined by the difference in diameters of the piston ends. A hopper 7 (FIG. 1) supplies a feed chamber 8 at one end of the die 5. At the other end of the die 5 is a pellet-removing zone 9 from which formed pellets, on leaving the die 5, can fall out of alignment with the die axis and then be removed to a store (not shown), so as not to interfere with the formation of subsequent pellets.

The die block 4 has a bearing aperture 10 for a plunger 11 which can slide so as to pass into and through the feed chamber 8, into and through the die 5, and into the zone 9. There is a pair of sealing 'O' rings 12 in the aperture 10 for the plunger 11. The die block 4 also has a bearing aperture 13 for a plunger 14 and a pair of sealing 'O' rings 15 for the plunger 14, the latter being slidable to occupy various positions within the die 5, the zone 9 and the aperture 13.

The yoke 3 carries a ram 19 with a piston rod 29. The ram 19 lies on the same axis as the die 5 and is axially adjustable for setting up purposes by means of a screwthreaded stud 20 which extends through an aperture 22 in one arm 23 of the yoke 3 and is secured by nuts 21. The other arm 24 of the yoke 3 is similarly provided with a ram 25 having a piston rod 33. The ram 25 lies on the same axis as the ram 19 and is similarly axially adjustable by means of a screwthreaded stud 26 which extends through an aperture 27 in the arm 24 and is secured by nuts 28. The piston rod 29 of the ram 19 is secured by a demountable coupling 30 to the plunger 11, and a bellows 31 sealed at one end to the die block 4 and at the other end to a part 32 of the ram 19/plunger 11 assembly, serves to prevent any leakage from the feed chamber 8 of valuable and/or environment-risk powder which may escape the 'O' rings 12. Similarly, the piston rod 33 of the ram 25 is secured by a demountable coupling 34 to the plunger 14, and a bellows 35 sealed at one end to the die block 4 and at the other end to a part 36 of the ram 25/plunger 14 assembly, fulfils the same purpose as the bellows 31.

The bed plate 1 has a ram 37 with a piston rod 39, secured to a lug 38 of the bed plate 1. The piston rod 39 of the ram 37 is secured to another ram 40 whose piston rod 41 is secured to a lug 42 on the yoke 3. The ram 37 has a screwthreaded stud 43 and nuts 44 enabling it to be set up in correct disposition, and the piston rod 41 of the ram 40 has its end region screwthreaded, such end being screwed into lug 42 and secured in desired axial position on setting up, by a lock nut 45.

It will be appreciated that by operating the rams 19, 25, 37 and 40 (each ram being a two-position ram, referred to subsequently as 'retracted' or 'advanced', as appropriate) in particular sequences, the plungers 11 and 14 can be made to occupy various positions both in the die block 4 and in relation to each other. An operational sequence will now be described accordingly.

Firstly, ram 19 is retracted, ram 25 is retracted, ram 37 is advanced and ram 40 is advanced. This places the plungers 11 and 14 in the positions where plunger 11 is to the side of feed chamber 8, enabling powder from hopper 7 to fill the chamber 8, and plunger 14 is occupying nearly all of die 5. In this position, the axial position of the plunger 11 can be adjusted by a small amount to vary the amount of powder which is taken for compaction. This adjustment is generally made for a whole run, not between sequences unless the compacts are out of tolerance.

The next step is for the ram 37 to be retracted, with the other rams holding their positions. This serves to move the plunger 11 into the die 5, driving the charge of powder before it, and to move the plunger 14 nearly out of the die 5, but with the same distance between the plungers as in the first step.

The succeeding step is for ram 19 and ram 25 to be advanced simultaneously whilst rams 37 and 40 hold their position. This causes the plungers 11 and 14 to move towards each other, compacting the powder charge into a pellet 47. During this step and for the conventional dwelltime which follows to allow compacting to reach equilibrium hydrostatic pressure is also applied to the powder charge through the conduit 49, annulus 48 and fluid permeable portion 6 of the die so that the entire surface area of the compacted powder is subjected to substantially uniform pressure, that acting on the cylindrical surface being close to that acting on the end surfaces but not greater. This is explained in more detail below. Thereafter the compacted pellet 47, is ejected into the pellet collecting zone 9 by operating ram 40 to retract it. Initially ram 25 is kept advanced so as to continue to grip the pellet 47 whilst ejecting it, but on completion of the retraction of ram 40, ram 25 is retracted, releasing the grip on pellet 47 and allowing it to fall away in zone 9. This is the position shown in FIG. 1.

Finally, ram 19 is retracted, and rams 37 and 40 are advanced, which moves the plungers 11 and 14 back to the positions they occupied at the beginning of the sequence. The sequence is then repeated.

The application of the hydrostatic pressure is synchronised with the operational sequence of the rams in the press apparatus so as to occur over that portion of the pressing cycle during which a powder charge is being compacted and the compacting pressure acting at the end surfaces of the compact exceeds a predetermined threshold. This synchronisation may be achieved by allowing the compaction pressure to enter the hydrostatic system (by means of a regulator valve, for example) at the threshold pressure or slightly before it is reached, the requisite pressure being developed in the hydrostatic system by means of an intensifier.

By selecting a suitable liquid as the fluid medium for permeating the die of the press apparatus the fluid medium may also serve to lubricate the die. The liquid will lubricate mainly the curved surface of the compacted powder but there will be some seepage on to the ends of the plungers which slide in the die and the die can be smeared with lubricant by the movement of these plungers.

I claim:

1. An improved press apparatus for forming bodies from ceramic powder having in combination a rigid die and means for applying mechanical pressure to powder within and contacting the die at least at one end of the die characterised in that the die is at least in part of fluid permeable material and means are provided for exerting hydrostatic pressure through a fluid medium permeating the die and contacting the powder while applying the mechanical pressure.

2. An improved press apparatus as claimed in claim 1 wherein the fluid permeable material is reaction-sintered silicon carbide from which its continuous silicon phase has been at least partially removed.

3. Apparatus for forming bodies from ceramic powder by compaction in a die, comprising a rigid die at least in part of fluid permeable material for receiving the powder, means for applying mechanical pressure to the powder, and means for exerting hydrostatic pressure through a fluid medium permeating the die and contacting the powder during application of said mechanical pressure.

4. Apparatus as claimed in claim 1 or claim 3 wherein the fluid medium is a liquid which also lubricates the die and the abutting surface of the ceramic body.

5. An improved method of forming bodies from ceramic powder by compaction in a rigid die at least in part of fluid permeable material, the improvement comprising exerting hydrostatic pressure through a fluid medium permeating the die and contacting the powder while applying mechanical pressure to the powder at least at one end of the die.

6. An improved method of forming bodies from ceramic powder as claimed in claim 3 wherein the fluid medium is a liquid and also lubricates the die.

7. An improved method of forming bodies from ceramic powder as claimed in claim 3 wherein the ceramic powder is uranium dioxide.

* * * * *